US005088013A

United States Patent [19]

Revis

[11] Patent Number: 5,088,013

[45] Date of Patent: Feb. 11, 1992

[54] CLIP FOR HOLDING MESSAGES WITH REMINDER LIGHT

[76] Inventor: Arthur N. Revis, 670 Beau Ct., Des Plaines, Ill. 60016

[21] Appl. No.: 574,894

[22] Filed: Aug. 30, 1990

[51] Int. Cl.[5] ..... F21V 33/00

[52] U.S. Cl. ..... 362/99; 200/61.59; 340/500

[58] Field of Search ..... 340/500; 116/202; 200/61.59, 61.63; 362/98, 99

[56] References Cited

U.S. PATENT DOCUMENTS

| | | | |
|---|---|---|---|
| 1,043,337 | 11/1912 | Merwin et al. . | |
| 1,673,595 | 6/1928 | Scoggins . | |
| 1,677,977 | 7/1928 | Menasco . | |
| 2,295,369 | 9/1942 | Thompson . | |
| 2,438,785 | 3/1948 | McKallick . | |
| 3,618,060 | 11/1971 | Nina | 340/224 |
| 3,781,844 | 12/1973 | Lowery et al. | 340/281 |
| 4,809,141 | 2/1989 | Leopoldi et al. | 362/99 |

*Primary Examiner*—Allen M. Ostrager

[57] ABSTRACT

A message-note holder has a fixed jaw member and a pivotal jaw member which is biassed toward the fixed jaw member by its own inherent springiness, which is achieved by the material from which it is made and by placing it in tension. The space between the lower ends of the jaw members defines the volume where a message-note is held by the note-holder of the invention. The pivotal jaw member has a laterally-projecting tubular member which is telescopingly and rotatably received within a tubular housing formed in the fixed jaw member, by which the two jaw members are rotatably coupled together. Within the tubular member of the pivotal jaw member there is provided an on-off switch for turning on and turning off a LED in alternating sequence of rotations or "squeezings" of the pivotal jaw member with respect to the fixed jaw member. Thus, when the pivotal jaw member is rotated for inserting a message-note between the lower ends of the jaw members, the switch closes a battery-powered circuit to energize the LED. When the note is removed by the person for whom the message was intended, or the like, by again rotating the pivotal jaw member, the switch de-energizes the LED. The switch has a first ratchet wheel rotatable with the rotatable tubular member of the pivotal jaw member. This first ratchet wheel meshes with a second ratchet wheel, which meshes with mating teeth on an interior-facing surface face of a stationary LED-housing assembly. The ratchet wheels are biassed together via a spring that its ends contacts the LED power electrode and at its other end of the battery source. The switch moves one end into or out of contact with the LED for making or breaking the electrical circuit.

14 Claims, 8 Drawing Sheets

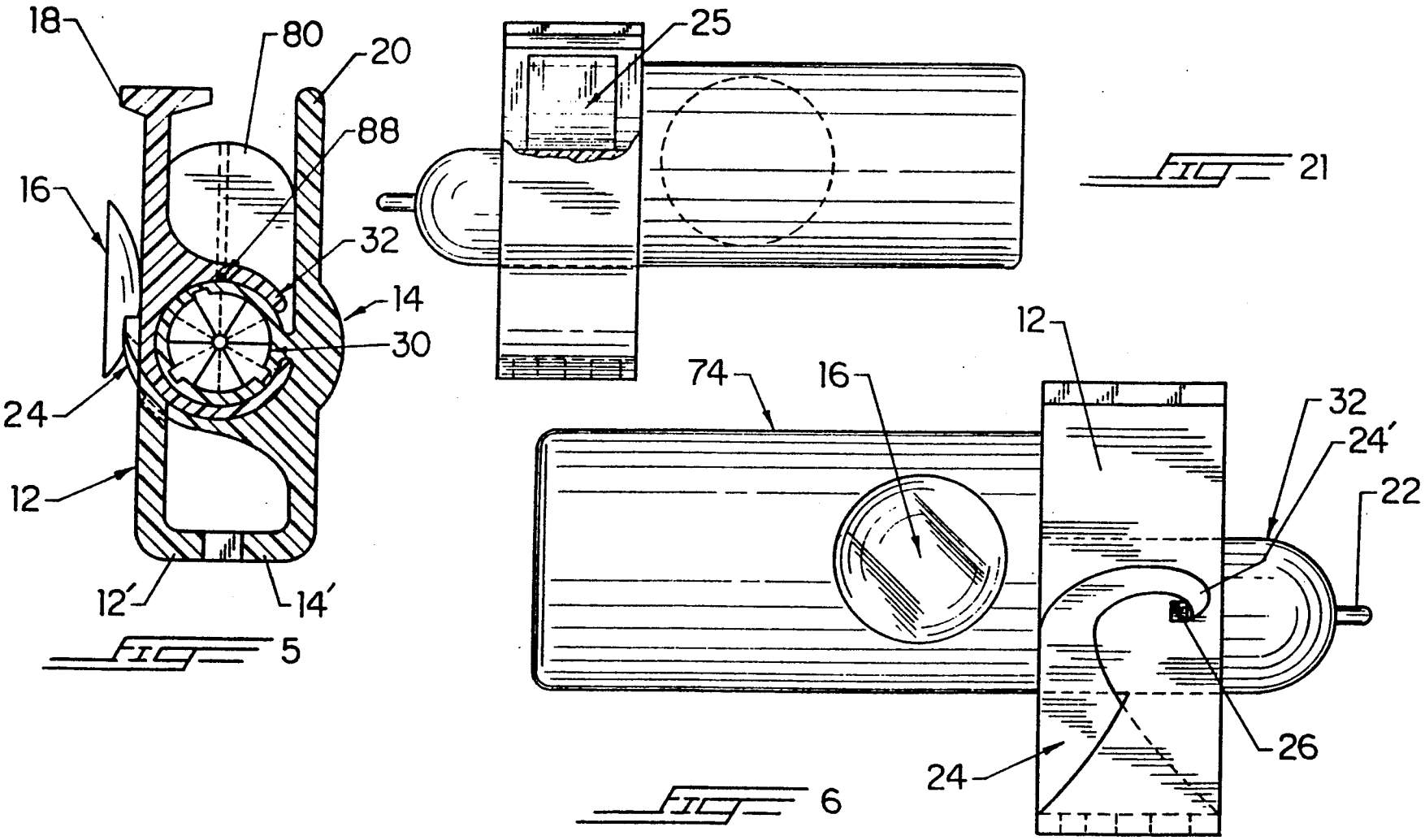
21
25
20
88
80
18
16
32
14
30
24
12
14'
12'
5
22
24'
32
26
12
16
74
24
6

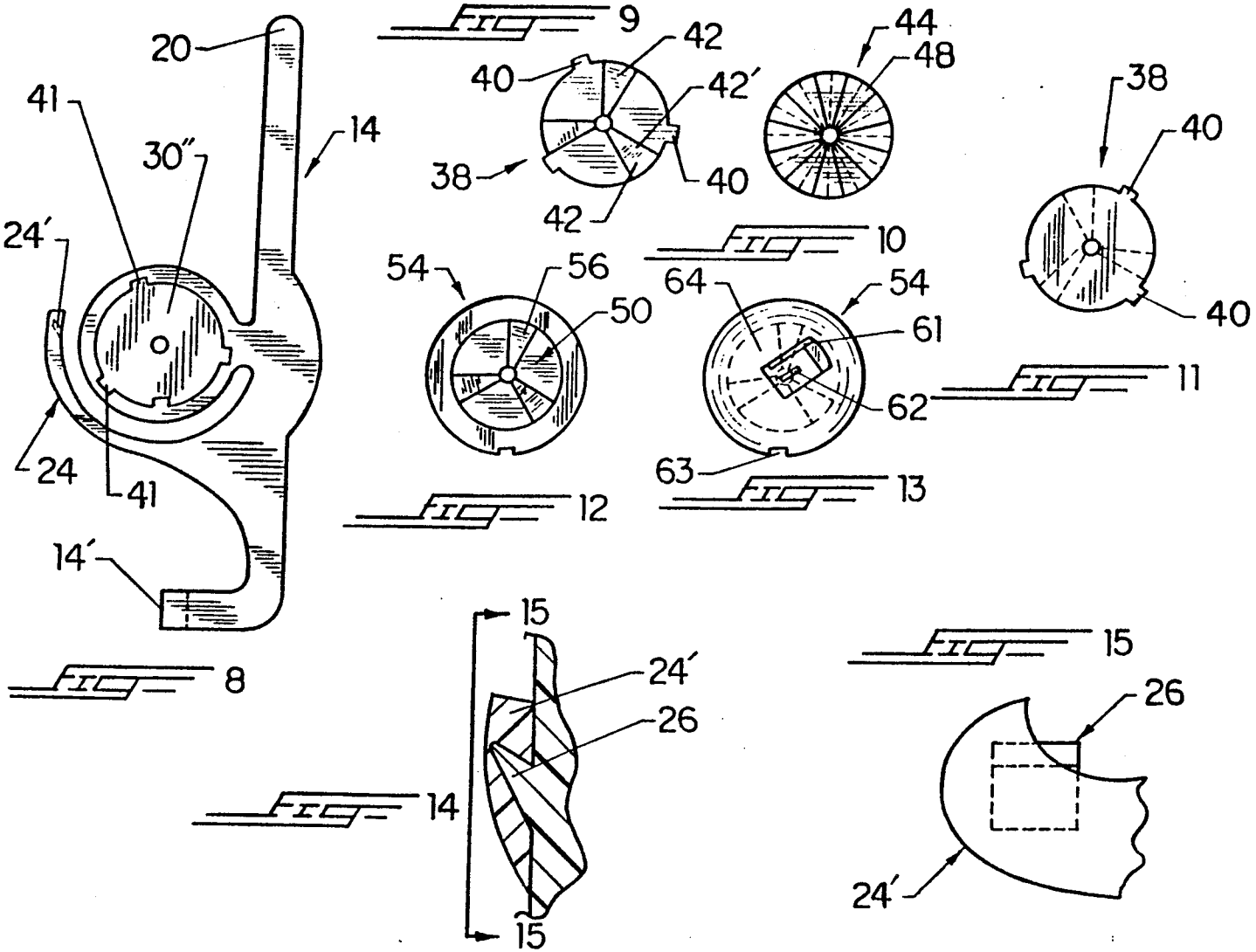
38
40
40
11
44
48
10
54
61
62
13
64
63
42
42'
40
9
40
38
42
56
50
12
54
14
20
30"
41
41
24'
24
14'
8
15
26
24'
24'
26
15
15
14

130
132

100

100
110
112
104
102
17
17
106
108
114
116

130
138
158
156
19
19
142
132
152
150
140
154
160

CLIP FOR HOLDING MESSAGES WITH REMINDER LIGHT

BACKGROUND OF THE INVENTION

The present invention is directed to a clip or holder for holding notes, papers, messages, and the like, which clip is mountable at a conspicuous place, whereby the note or message may be easily seen in order to draw one's attention to it. Reminder-note clips or holders are known. An example of one is shown in U.S. Pat. No. 3,781,844—Lowery, et al—in which the note-holder has a flashing light energized when a note has been inserted into the holder. The illumination of the flashing light is directly dependent upon the insertion of the paper-edge into the entrance of the holder, which pivots a contact arm for completing an electrical circuit, which contact-arm also serves the function of holding the note. The degree to which the note may be gripped by the holder is limited to a great degree, with the insertion of the note into the holder difficult to achieve for some thin sheets of paper, since there must be enough strength if the sheet of paper is to achieve the pivoting of the contact-arm. The degree to which the note may be gripped by the holder is, therefore, limited by the need to rotate the contact-arm by the paper itself. Thus, placement of the holder of Lowery, et al on a vertical surface is not practicable, since the holding force may not be sufficient to prevent the note from falling out.

SUMMARY OF THE INVENTION

It is the primary objective of the present invention to provide a written-message note holder that clamps the note firmly, allowing the holder of the invention to be placed an any horizontal sloping or vertical surface while still retaining the note.

It is another objective of the invention to provide such a note-holder that grips the note firmly, and which is provided with an indicating light that is automatically turned on when a message-note has been inserted into the holder, and which light is automatically turned off when the message-note has been removed.

It is still another objective of the invention to provide an illuminated note-holder in which there are provided a pair of jaws for holding the message-note therebetween, one such jaw being pivotal with respect to the other jaw, such that, upon rotation of the pivotal jaw, a switching circuit is controlled to alternatively energize or de-energize the indicating light.

It is still another objective of the invention to bias the pivotal jaw toward the fixed jaw by using the inherent material from which the pivotal jaw is made, thereby obviating the need of springs, and the like.

It is yet another objective of the present invention to provide a series of note-holders powered from the same source, whereby such series of note-holders may be used in an office for indicating messages to a number of personnel.

Toward these and other end, the note-holder in the preferred embodiment is battery-powered, and has a fixed jaw member which is securable to a vertical, horizontal or sloping surface via a suction cup, or other conventional mounting structure. Connected to the fixed jaw member is a pivotal jaw member, which is spring-biassed toward the fixed jaw member by its own inherent springiness, which is achieved by the material from which it is made and by placing it in tension. The space between the lower ends of the jaw members defines the volume where a message-note is held by the note-holder of the invention. The pivotal jaw member has a laterally-projecting tubular member which is telescopingly and rotatably received within a tubular housing formed in the fixed jaw member, by which the two jaw members are rotatably coupled together. Within the tubular member of the pivotal jaw member there is provided an on-off switch for turning on and turning off a LED in alternating sequence of rotations or "squeezings" of the pivotal jaw member with respect to the fixed jaw member. Thus, when the pivotal jaw member is rotated for inserting a message-note between the lower ends of the jaw members, the switch closes a battery-powered circuit to energize the LED. When the note is removed by the person for whom the message was intended, or the like, by again rotating the pivotal jaw member, the switch de-energizes the LED. The switch for accomplishing alternating closings and openings of an electrical circuit for the very same rotation of pivotal actuating arm has a first ratchet wheel rotatable with the rotatable tubular member of the pivotal jaw member. This first ratchet wheel is provided with outwardly-facing, sloped teeth or ramps meshing with cooperating, mating teeth projecting from a first lateral side surface of a second ratchet wheel. The teeth of the second ratchet wheel have an alternating pattern of deeper and shallower teeth. The other lateral side surface of the second ratchet wheel has a similar teeth-arrangement as the first lateral side surface thereof, but 15 degrees out of phase therewith. The teeth of the second lateral side surface of the second ratchet wheel engage with mating teeth on an interior-facing surface face of a stationary LED-housing assembly. The ratchet wheels are biassed together via a spring, the laterally-outwardly facing end of which is extended into an approximate, linear contact lead passing through center holes formed in each ratchet wheel and in the LED-housing. The distal end of this contact lead of the spring is alternatively moved into and out contact with the LED-electrode for alternatively closing and opening the electrical circuit powering the LED. When the teeth arrangement on the surface faces of the first ratchet wheel and the LED-housing are received in the deeper teeth, the switch of the invention is placed in its closed state, whereby the lead-end of the spring is brought into contact against the LED terminal. When the shallower teeth are engaged, the switch is in its open state, spacing the lead-end of the spring from the LED terminal. Impartations of rotation to the pivotal jaw member cause this alternating sequence of "on" and "off", via the sloping or ramped nature of the teeth on the first ratchet wheel, which allow the first ratchet wheel to return to its original condition when the pivotal jaw member is released. The second or middle ratchet wheel is prevented from also returning to its original state with the first ratchet wheel via the teeth arrangement on the surface face of the LED-housing, which provides a pawl-like effect by allowing rotation of the middle or second ratchet wheel in one direction but preventing rotation in the other direction.

The pivotal jaw member is biassed toward the fixed jaw member such that the lower, clamping jaw-ends thereof are urged toward each other, by utilizing the inherent springy or resilient characteristics of the material from which the pivotal jaw member is made. In the preferred embodiment, the material used for the pivotal jaw member is made of the acetal copolymer manufactured by Mitsubishi Gas Chemical Company under the name "IUPITAL". Owing to the unique nature of this plastic, by placing it in tension, it assumes spring-like functioning. Therefore, the pivotal jaw member of the invention has an integrally-formed tensioning arm provided with a hook-end, which hook-end is entrained around a projection or protuberance provided on an exterior surface portion of the fixed jaw member. By means of this tensioning arm, the pivotal jaw member is placed in tension, by which it is inherently biassed toward the fixed jaw member, yet still capable of withstanding rotation relative to the fixed jaw member an arcuate movement of rotation of approximately 20 degrees.

BRIEF DESCRIPTION OF THE DRAWINGS

The invention will be more readily understood with reference to the accompanying drawing, wherein:

FIG. 5 is a cross-sectional view taken along line 5—5 of FIG. 4;

FIG. 6 is a rear view thereof;

FIG. 8 is a cross-sectional view taken along line 8—8 of FIG. 7;

FIG. 9 is a cross-sectional view taken along line 9—9 of FIG. 7;

FIG. 10 is a cross-sectional view taken along line 10—10 of FIG. 7;

FIG. 11 is a cross-sectional view taken along line 11—11 of FIG. 7;

FIG. 12 is a cross-sectional view taken along line 12—12 of FIG. 7;

FIG. 13 is a cross-sectional View taken along line 13—13 of FIG. 7;

FIG. 14 is a cross-sectional view taken along line 14—14 of FIG. 2;

FIG. 15 is a cross-sectional view taken along line 15—15 of FIG. 14;

FIG. 21 is a front view thereof, and partially broken away to show the U-shaped resilient biassing arm;

DETAILED DESCRIPTION OF THE INVENTION

Figures 1, 2, 3, 20:
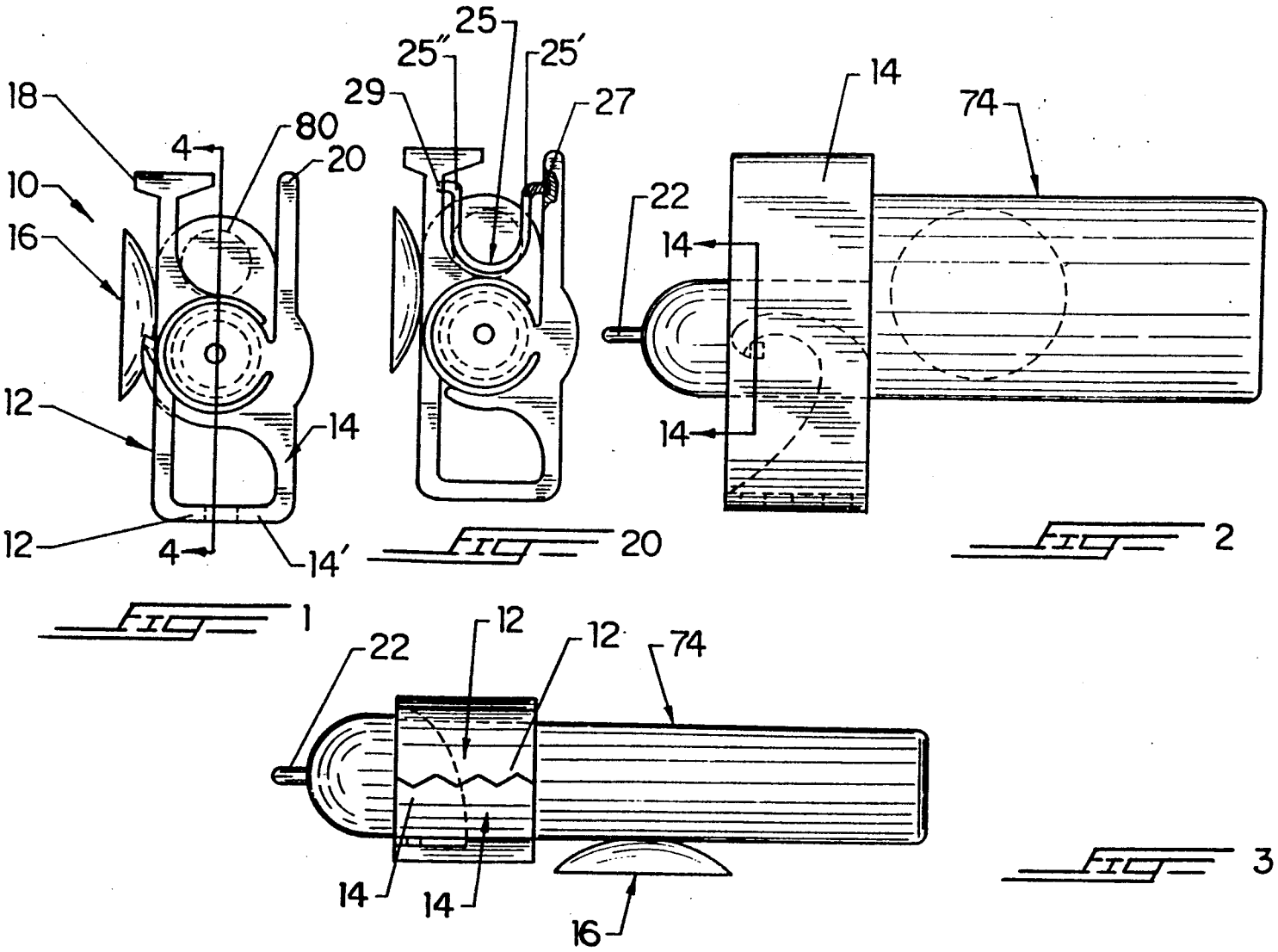
FIG. 1 is a side elevational view of the note-holder of the invention.
FIG. 2 is a front view thereof.
FIG. 3 is a bottom view thereof.
FIG. 20 is a side elevational view of another modified form of the invention in which a U-shaped resilient biassing arm is provided.

Referring now to the drawings in greater detail, the message-note holder of the invention is indicated generally by reference numeral 10. The message-note holder 10 has a pair of jaw or clamping members 12, 14, with the jaw member 12 being fixed or stationarily mounted to a vertical or sloping wall surface, or the like, via a suction cup 16. The suction-cup attachment allows for facile mounting and removal of the device to and from a refrigerator door, for example, or at a location where the message will be more readily noticeable. The jaw member 14 is pivotal with respect to the fixed jaw member 12 via a rotary interconnection described below in greater detail. When viewing FIG. 1, the pivotal jaw member 14 is rotatable to its open, note-receiving position in the counterclockwise direction. Each jaw member defines a substantially L-shaped lower section, in profile, where each has a lower horizontal leg or clamping section 12', 14', respectively, which about each other in the normal, biassed state of the holder, to hold a message-note therebetween. Each clamping section 12', 14' has a jagged or sawed edge-surface, as seen in FIG. 3, for better gripping the message-note. The fixed jaw member also has a flange extension 18 which is used for squeezing the movable jaw member theretoward when pivoting or rotating the movable jaw member via its upper arm portion 20, whereby one finger-push of the hand may easily and simply open the jaws to allow the other hand to insert a note therebetween. The fixed jaw member also has associated therewith an illuminated indicator, which in the preferred embodiment is a LED 22. The LED is alternatively energized or de-energized after each rotation of the movable jaw member 14 via a switch-connection, described below in greater detail, which switch-connection is operative in response to the rotation of the movable jaw member to its open state. The LED is illuminated to indicate that a message has been inserted into the jaws, and is shut off when the note has been removed.

Figure 4:
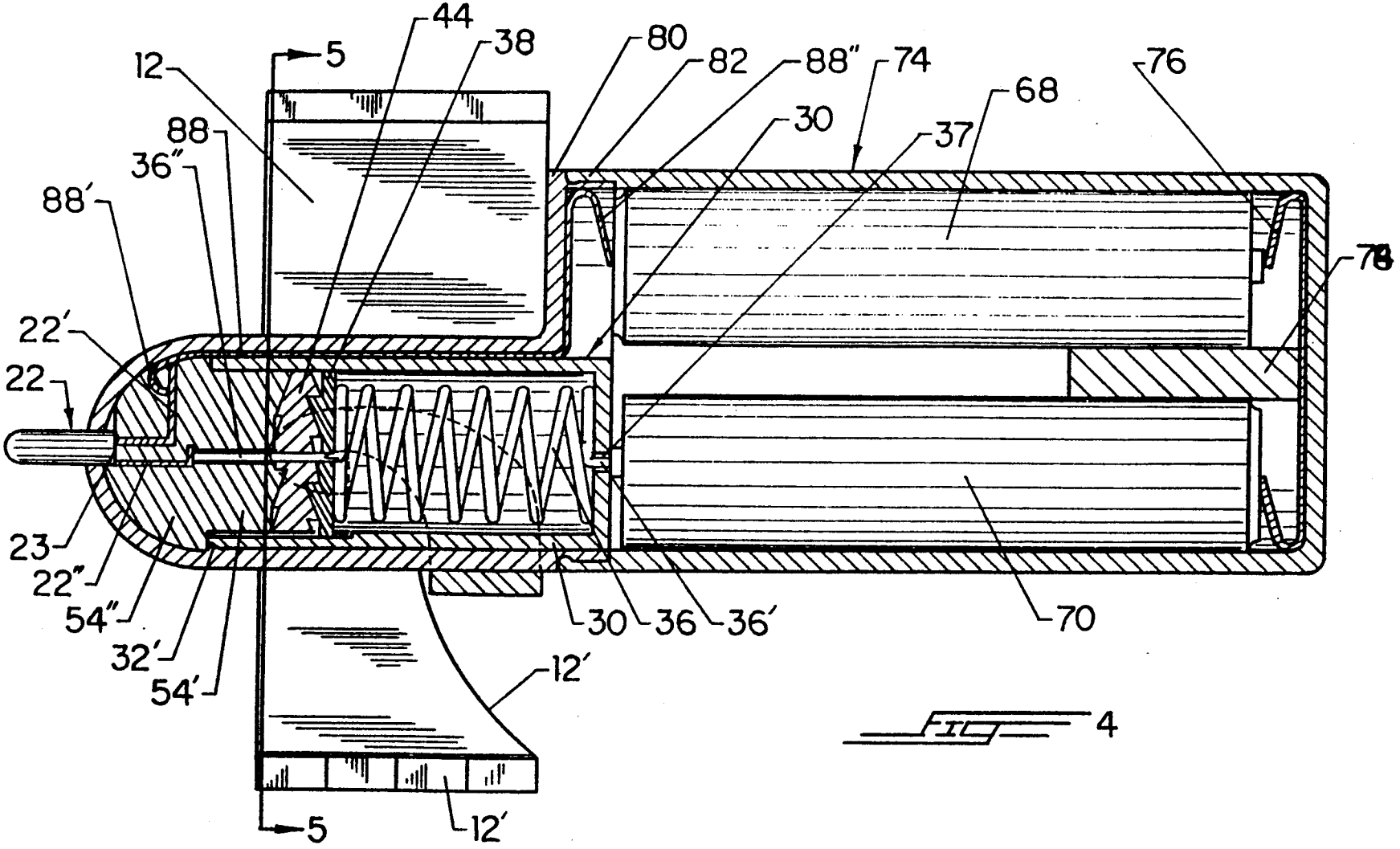
FIG. 4 is a cross-sectional view taken along line 4—4 of FIG. 1.
Figure 7:
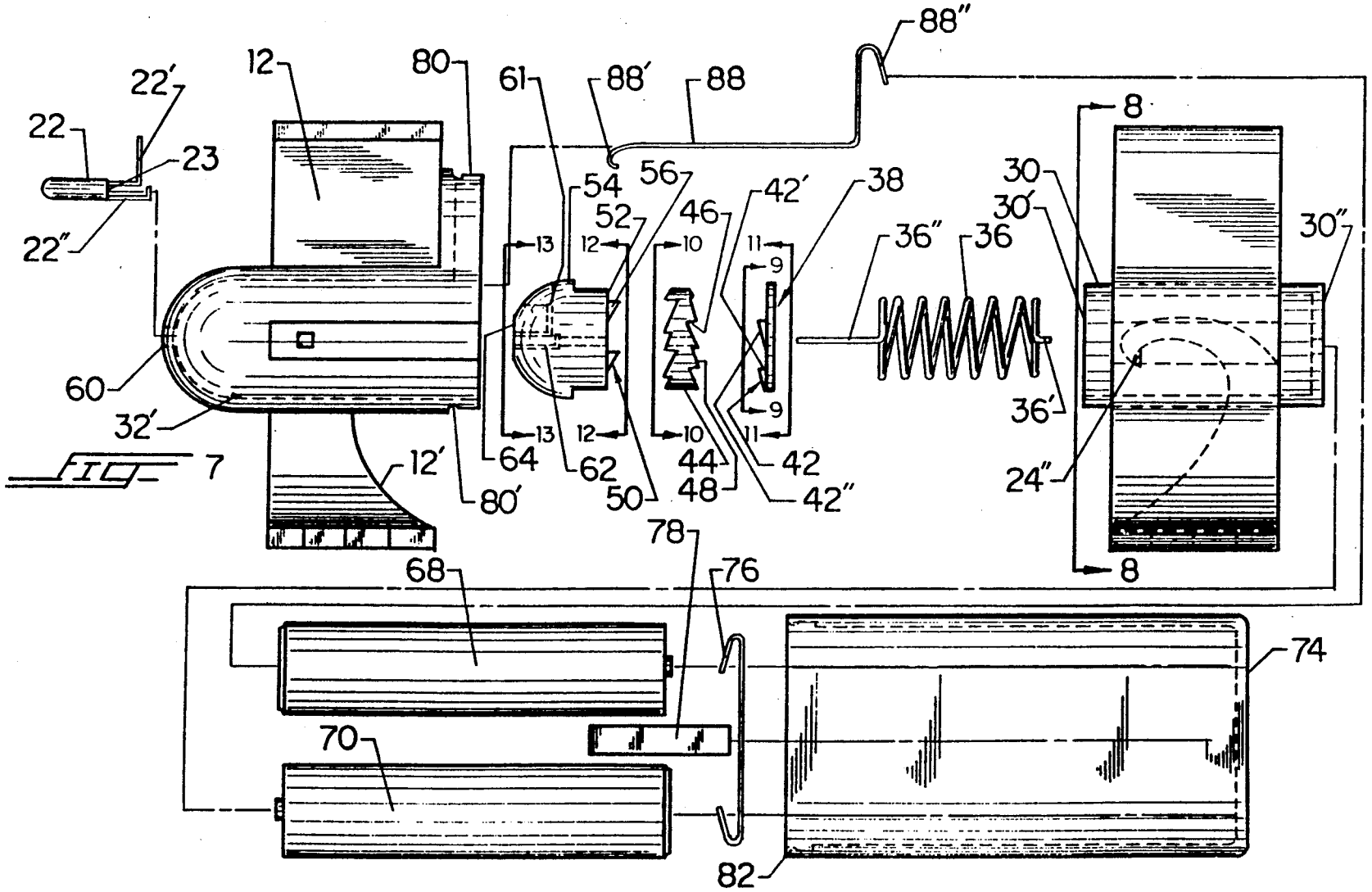
FIG. 7 is an assembly view of the parts of the note-holder of the invention.

The movable jaw member 14 is biassed into its closed, clamping state without the use of a spring (although a helical metal wire compression spring could be alternatively used between ends 18 and 20 of FIG. 1), but, rather, the inherent, flexible and resilient characteristics of the material from which the movable jaw member is made is utilized to provide a self-biassing return-force. The jaw member 14 is made of acetal copolymer manufactured by Mitsubishi Gas Chemical Company under the name "IUPITAL". Integral with the movable jaw member is a spring-arm securement 24, best seen in FIGS. 2, 6, 7, 8, 14 and 15, made of the same material, having a thickness of between 0.060 and 0.100 inch. The spring-arm 24 is substantially spiral-shaped, and originates from adjacent the lower clamping section 14' and terminates in a thin, hooked end 24'. The spring-arm 24 gradually reduces in width from its origin to the hooked end 24' thereof, as best seen in FIG. 6. The hooked end 24' cooperates with, and is held fast by, a protuberance or catch 26 provided on the exteriorly facing surface of the fixed jaw member 12, whereby the hooked end 24' is snapped in place over the knob 26, as seen in FIG. 6, and in detail in FIGS. 14 and 15. The knob or protuberance 26 is preferably an inclined member, with the hooked end 24' having a sloped or canted contact surface 24" that abuts against and is held by the knob 26. The spring-arm spirals upwardly as seen in FIG. 6, from the rear of the movable jaw member 14, when viewing FIG. 1, and as seen in FIG. 6, with the lower, rear portion of the fixed jaw member 12 having a cutout 12' in order to accommodate the spring-arm and allow its passage therepast, as seen in FIGS. 4 and 7. When assembling the two jaw-members together, the spring-arm is wrapped about, or hooked onto, the catch 26 by forcing the spring-arm 24 over and above the catch 24, and then allowing the hooked end to be caught by the protuberance 24. This attachment of the hooked end and the catch is achieved automatically as the two jaw members are assembled by the curved or arcuate outer surface 25 of the hooked end, which acts as a cam for forcibly bending the spring-arm upwardly, when viewing FIG. 6, during assembly, with the hooked end 24' thereafter returning to be caught by the catch 26 by its own resiliency, as mentioned above. Thus, the sloped outer surface 25 is substantially colinear with the knob or catch 26. Disassembly is easily achieved by forcing the hooked end up and out of contact with the knob 24, and, thereafter, separating the two jaw members 12, 14. The placement of the knob 24 is such that, when the hooked end 24' is snap fitted thereon, the spring-arm 24 is stretched or placed in tension, to thereby create the self-biassing force above-mentioned, which self-biassing force inherently biasses the movable jaw member 14 into the clamping, clockwise direction when viewing FIG. 1, with the moment of force created thereby being directed below the rotatable sleeve or tube that rotatably mounts the movable jaw member to the fixed one, as set forth below in greater detail. It is, therefore, seen that the two jaw-members are biassed together without the use of a spring.

Referring to FIGS. 4 and 7, the movable jaw member 14 is rotatably coupled to the fixed jaw member 12 via a hollow, tubular mounting sleeve 30, which sleeve 30 has an open end 30' and a closed end 30". The sleeve 30 is mounted at the central section of the movable jaw member 14, and projects laterally from each side thereof. The tubular sleeve mounts in its interior the switching mechanism for causing the LED to go on and off alternatively with the pivotal openings of the movable jaw member. The tubular sleeve 30 is telescopingly received in a cylindrical-shaped housing 32 mounted at the central section of the fixed jaw member 12, whereby the tubular sleeve member may rotate within the housing 32 when the movable jaw member's upper portion 20 is squeezed toward the fixed jaw member to open the jaws, such opening being resisted by the tensioned spring-arm 24 above-described. The relative rotation between the sleeve 30 and housing 32 is achieved via the smooth, low-friction surfaces of the materials from which the jaw members are made, and by the slightly-slack mounting therebetween, with the movable jaw member preferably being made of reinforced or unreinforced acetal, and the fixed jaw member being made of either acetal or polypropylene.

The switching mechanism is housed within the tubular sleeve 30, and consists of a compression spring 36 having a first lateral end 36' and a second, elongated end 36". The closed end 30" of the sleeve 30 has a central hole 37 through which projects the end 36' of the spring 36, as seen in FIG. 4, for contacting the positive terminal of a battery, discussed below. A first, or drive, ratchet wheel or gear 38 is provided which has a central hole through which passes the end 36" of the spring 36. The ratchet wheel 38 is circular in cross section, and is best seen in FIGS. 9 and 11. The ratchet wheel 38 has three peripherally projecting ears or guides 40 which are received and guided in three slots or grooves 41 (FIG. 8) formed in the inner circumferential surface of the tubular sleeve 30. The ears 40 and the slots 41 are spaced 120 degrees apart, which connection allows for easy assembly of the first ratchet wheel in the sleeve, and ensures that rotation of the rotatable jaw member is also imparted to the first ratchet wheel. One lateral surface face of the first ratchet wheel 38 is provided with three laterally-outwardly facing teeth or gear surfaces 42 defining contact surfaces 42' and sloping transition surface 42", by which a second or intermediate, unidirectional ratchet wheel 44 is rotated. The angular extent of each sloping transition surface 42" is 15 degrees.

The intermediate ratchet wheel 44, best seen in FIG. 10, has a pair of lateral surface faces from each of which project a series of teeth or gear projections. Each lateral surface face's arrangement of teeth are the same, with the only difference being that they are staggered or out of phase with each other by 15 degrees, which is less than the 20 degree rotation of the movable jaw member. The teeth arrangement on each surface face is as follows. There are provided twelve deeper teeth or projections 46, and twelve shallower teeth or projections 48, provided in alternating sequence of one deeper and one shallower, so that the teeth 42 of the first or drive ratchet wheel 38 may alternatively enter into a shallower depression and then a deeper one, in order to cause the alternating sequence of "on" and "off" of the LED, as set forth below in greater detail. Each tooth or depression 46, 48 has a sloping surface face like that of the teeth of the first ratchet wheel, so that when the drive ratchet wheel 38 is rotated back to its original, clamping-state position, such return movement will be accommodated by the intermediate ratchet wheel, in pawl-like manner, whereby the teeth 42 will be set for contact against and engaged with the next set of either shallower or deeper teeth 46, 48 during the next rotation of the movable jaw member into its open, nonclamping position.

A third, nonrotatable and fixed ratchet wheel or member 50 is provided, which defines a lateral surface face 52, as best seen in FIG. 12. In fact, the surface face 52 is part of an overall LED housing 54, as seen in FIG. 7. The surface face 52 is provided with teeth or projections 56 identical to those on the first ratchet wheel 38. Each of the intermediate ratchet wheel 44 and LED housing 54 has a central hole or opening through which projects the end 36" of the spring 36, by which spring the ratchet wheels and ratchet faces are urged together into operative contact and engagement. The LED housing 54 is received within the housing 32 of the fixed jaw member, at the lateral end thereof, which lateral end thereof has a linear opening 60 through which extends and projects the LED proper 22. The LED housing 54 has a smaller-diameter portion 54' (FIG. 4) that is received within the tubular sleeve member 30, and a larger diameter portion 54" that projects outwardly from the open end 30' of the tubular sleeve, which larger section 54" is dome-shaped and received snugly in the lateral end of the housing 32, as described above. The LED housing is held in place in the housing 32, and prevented from rotating, via a lip 32' (FIG. 4) formed in the interior of the housing 32, by which the step between the larger and smaller diameter sections of the LED housing is snap-fitted in place in the housing 32 in groove 63 (FIG. 13) and prevented from escaping, the outer convex or dome-shape of the LED housing allowing ease of insertion thereof into the interior of the housing 32 by camming action.

The LED housing 32 is provided with a appropriate grooves or cutouts by which the LED 22 is mounted, by which the electrical leads 22', 22'' thereof are accommodated. A first L-shaped groove 61 is formed through the front of the dome-shaped surface 54 when viewing FIG. 7, and a second L-shaped groove 62 is also provided, by which the leads 22' and 22'', respectively, may be inserted into the dome-shaped LED housing 54. These grooves terminate laterally at a flat surface 64 from which projects the LED 22, with its inner flat surface 23 lying flush against the flat surface 64, as best seen in FIG. 4, whereby the LED 22 with its leads is simply dropped into place in the housing 54 by inserting the leads 22', 22'' into the L-shaped grooves 61, 62.

It may be seen, therefore, that as the movable jaw member 14 is pivoted or rotated into its open, non-clamping state, the sleeve 30 is rotated with it, which, in turn, causes the rotation of the drive ratchet wheel 38, which thereby causes the rotation of the intermediate ratchet wheel 44. Assuming that at the outset, for example, the teeth 42 of the drive ratchet wheel 38 were engaged with the deeper depressions or teeth 46 of the intermediate ratchet wheel 44, with the like teeth 56 of the last or fixed ratchet face 50 also engaged with the deeper depressions or teeth on the other lateral side face of the intermediate ratchet wheel 44, which means that the LED is turned on since the end 36'' of the spring is brought into contact with the electrode 22'' of the LED 22, thereby closing an electrical circuit with batteries 68, 70, discussed below, the rotation of the movable jaw member and the drive ratchet wheel 38 causes the intermediate ratchet wheel to rotate along with the drive ratchet wheel to bring the teeth 56 of the last fixed ratchet face out of contact with the deeper teeth or depressions 46, and into contact with the shallower ones 48, which contact also serves as a pawl-like connection preventing the intermediate ratchet wheel from reverse-rotating as the movable jaw member is released and allowed to return to its original clamping state. This return movement of the movable clamping jaw also causes the drive ratchet wheel to rotate therewith in the opposite direction, this being allowed by the canted surfaces 42'' thereof sliding past the cooperating canted surfaces of the teeth of the intermediate ratchet wheel 44, whereby the teeth 42 of the drive ratchet wheel now become engaged within the shallower teeth or depressions 48 of the intermediate ratchet wheel, as are the teeth of the last, fixed ratchet fact 50, whereby the end 36'' of the spring is brought out of contact with the electrode 22'', to thereby open the electrical circuit, to turn the LED 22 off. This "off" state occurs because the spring surface flush with the surface face of the drive ratchet wheel 48 is moved closer to the closed end 30'' of the sleeve 30, thereby also carrying with it the end 36''.

In the preferred embodiment, the movable jaw member is rotatable or pivotal through an angle of 20 degrees. Thus, there are provided the above-mentioned six shallower and six deeper teeth 46, 48 on each face of the intermediate ratchet wheel 44. That is, the shallower and deeper teeth are spaced about each surface face of the ratchet wheel 44 such that each spans the arcuate distance of 30 degrees. Thus, when the movable jaw member is pivoted 20 degrees, and the drive ratchet wheel therewith, the intermediate wheel is rotated 15 degrees.

As mentioned above, the holder 10 is powered by a pair of AAA batteries 68, 70. A battery housing 74, made of plastic or similar non-conductive material, is provided which mounts the batteries therein, with an electrical spring clip 76 providing the electrical connection between the positive electrode of battery 68 and the negative electrode of battery 70. Spacer element 78 spaces the batteries in the housing for a tight fit therein and for electrical separation therebetween. The housing 74 is removably mounted to the fixed jaw member via enlarged portion 80 thereof, as seen in FIGS. 4 and 7, which is generally elliptical in cross section to match the same shape of the battery housing 74. The housing 74 is snap-fitted onto the end of the enlarged portion 80 via an annular recess 80' that receives an inner, peripheral bead or lip 82 formed in the open end of the housing 74, which allows easy and fast removal of the housing for replacement of batteries.

The electrical circuit for energizing the LED 22 is as follows. As mentioned above, the end 36' of the spring 36 projects through the hole 37 of the closed end of the tubular sleeve 30 for providing the electrical connection to the positive electrode of the batter 70. The spring-end 36'', when the ratchet wheels are positioned in their closest spacing via the deeper ratchet teeth of the intermediate ratchet wheel 44, contacts the LED's positive electrode 22''. The negative electrode 22' of the LED 22 is electrically connected to a spring clip 88 at its end 88', the other end 88'' of which is connected to the negative electrode of the battery 68, to complete the circuit, as best seen in FIGS. 4 and 7. Of course, as explained above, when the ratchet wheel teeth are engaged in the shallower teeth of the intermediate ratchet wheel, the spring-end 36'' is moved out of contact with the lead 22'', to open or break the electrical circuit. It is noted that the spring clip 88 is mounted between the tubular sleeve 30 and housing 60 as seen in FIG. 4. Each end 88' and 88'' is hooked or bent over in order to provide a connection that is biassed into electrical contact with its respective contacts, in order to provide a surer electrical connection.

Figures 16, 17, 18, 19:
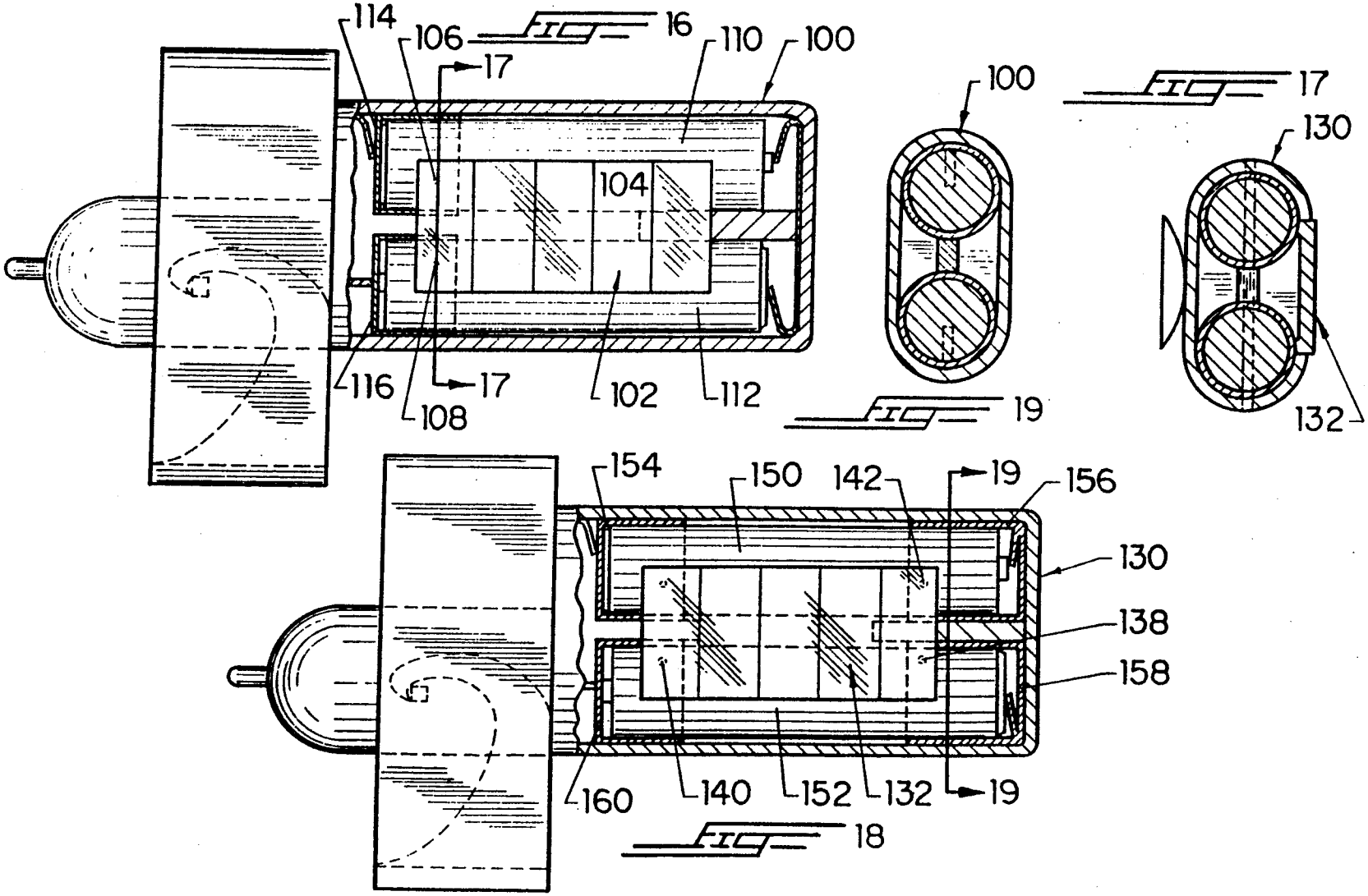
FIG. 16 is a front view, in partial cross section, showing a second embodiment of the note-holder of invention which incorporates a LED timer-display.
FIG. 17 is a cross-sectional view taken along line 17—17 of FIG. 16.
FIG. 18 is a front view, in partial cross section, showing a modification of the second embodiment of FIG. 16.
FIG. 19 is a cross-sectional view taken along line 19—19 of FIG. 18.

Referring to FIGS. 16 and 17, there is shown a modification of the clip-holder of the invention, and indicated generally by reference numeral 100. The holder 100 is identical to the holder 10 with the exception of the addition of a conventional LCD-digital time-display 102. The time-display 102 is comprised of a housing 104 which forms part of the outer battery housing, whereby such is readily seen. Two electrodes 106, 108 of the LCD digital display are connected to the batteries 110, 112 via circular connectors 114, 116, as clearly shown in FIG. 16, by which the LED display is powered continuously, regardless of the position of the ratchet-switch.

FIGS. 18 and 19 show a modification of the holder of the invention with a LCD digital time-display, and is indicated by reference numeral 130. The holder 130 is substantially identical to the holder 100, with the exception of the use of a different type of LCD digital time-display 132, which has a pair of negative and a pair of positive electrodes 136, 138 and 140, 142, respectively, which electrodes are electrically connected to the batteries 150, 152 via circular can-shaped connectors 154, 156, 158, and 160.

FIGS. 20 and 21 show another modification of the note-holder in which the biassing arm 24 of the holder of FIG. 1 is replaced with a U-shaped resilient biassing member 25 which has a first upper end 25' received in a notch 27 formed in the upper interior portion of the movable jaw member, and a second upper end 25" received in a notch 29 formed in the fixed or nonmovable jaw member. The U-shaped member 25 is also preferably made of the same material as the arm 24, i.e. acetal. The U-shaped arm 24 may also be formed integrally with the movable jaw member in the same manner as that of arm 24, in which case the notch 27 would not be needed.

Referring to FIGS. 22–26, there is shown the use of a message-center racking device 200 for use in mounting a series of holders, each holder made according to invention. This is ideally suited for use in an office, and the like, where each holder and its associated LED is designated for a specific employee for indicating telephone messages received, and the like. The message-center rack 200 includes a plurality of note-holders 210 with LED 212 identical to that shown in FIG. 1, but instead of each holder being individually and separately powered by a battery source, a common power source is used for all of the holders 210.

Each of the holders 210 includes a downwardly projecting terminal-housing 214 made of suitable nonconductive plastic, and the like, which housing 214 replaces the battery housing 74 of the embodiment of FIG. 1. The housing 214 may be formed integrally with the rest of the note-holder 210, or may be snap-fitted on in the same manner described above with respect to the battery housing 74. It is the intent to make the housing 214 the same as the battery housing 74; i.e., the note-holder 10 with battery housing 74 is placed as an entire unit into the message-center rack 200 of FIGS. 22–26. The housing 214 does have a lower central opening 216 that allows for the projection therethrough of terminals, as described below. Each note-holder 210 also has a downwardly extending positive-electrode, spring-end, contacting member 218 which is the equivalent of the spring-end 36' of FIG. 7, for contacting a positive electrode 220 housed in terminal-housing 214. The positive electrode 220 is part of a coaxial-type electrode combination, which also has an outer negative electrode 222 telescopingly mounted about the inner member 220, both of which electrodes 220, 22 are electrically isolated by an intervening layer of electrically-insulating material 224. The electrodes 220, 222 project downwardly and out of the housing 214 via the above-mentioned lower central opening 216. The outer negative electrode is contacted at its upper end by a metal clip 219 which is the functional equivalent of the clip 88 of FIG. 7 of the note-holder 10 of the first embodiment.

Figure 25:
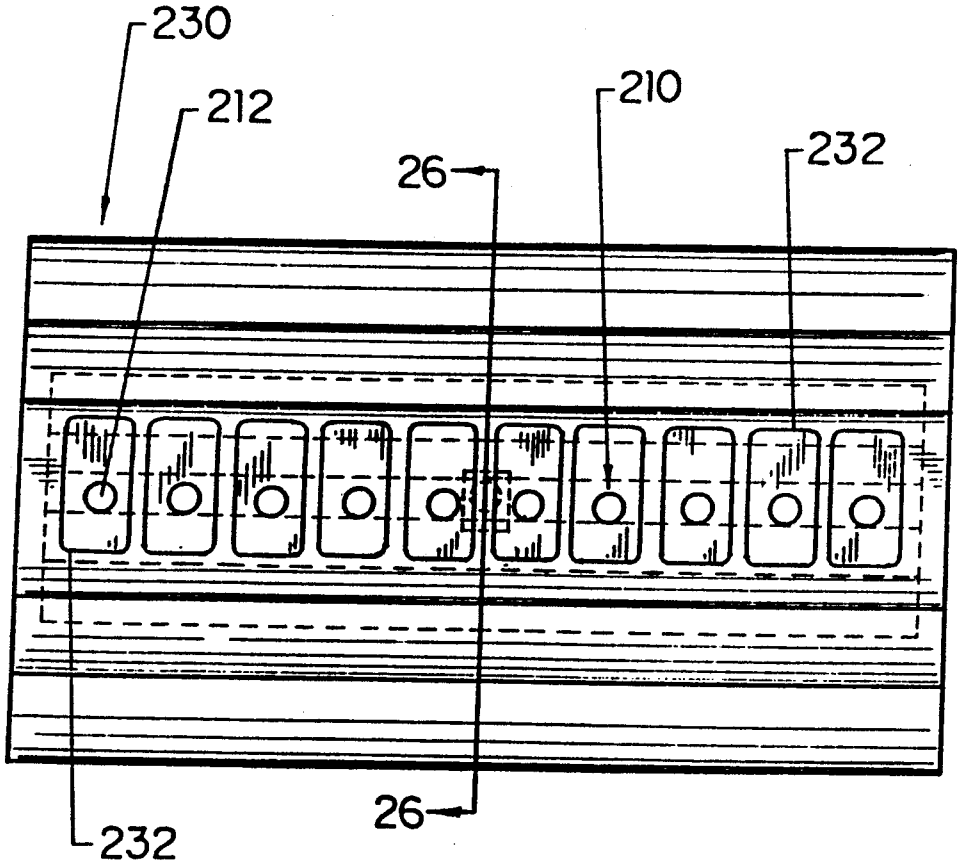
FIG. 25 is another front view of the third embodiment of the invention.

The holders 210 with their associated terminal-housings 214 are removably mounted in an elongated, main mounting frame 230 defining a plurality of linearly-aligned vertically-oriented receptacles or chambers 232, as best seen in FIG. 25. As mentioned above, each note-holder 210 is simply dropped into a respective chamber 232, including its housing 214. Also as mentioned above, the housing 214 also serves as the battery housing 74 of the embodiment of FIG. 1, so that the unit 210 may be removed from the assembly 200 and used independently thereof by inserting the necessary batteries into the housing 214, in the manner described above with reference to the embodiment of FIG. 1, with the metal contacts 218 and 219 providing the coupling to the LED electrodes.

Figure 23:
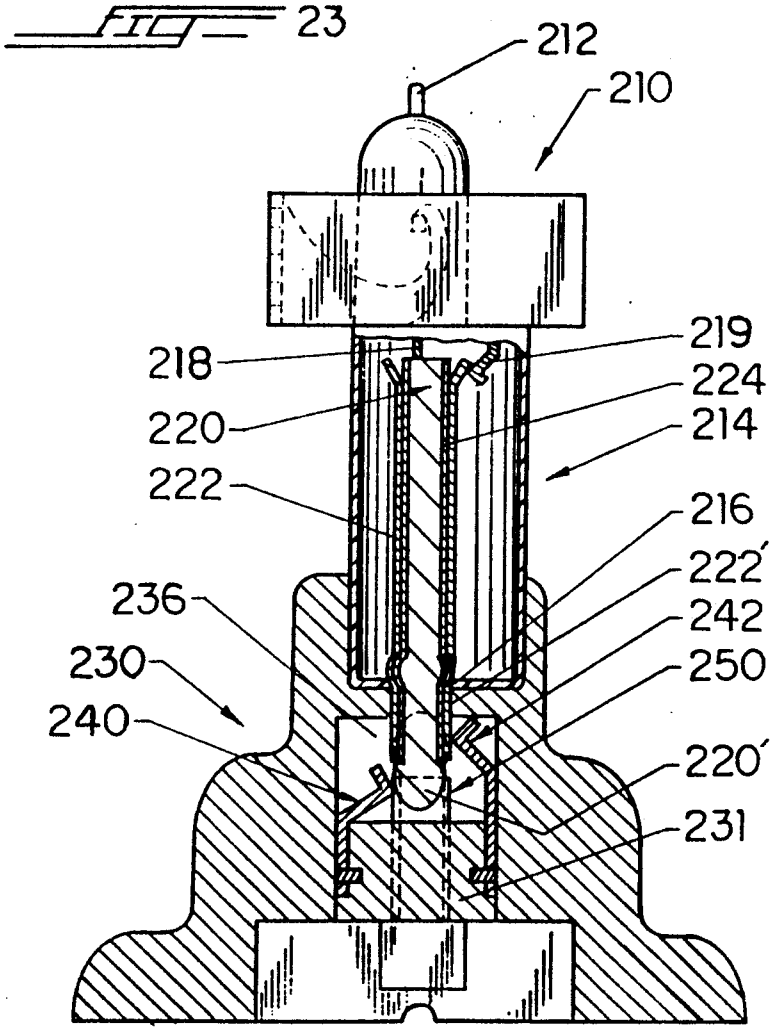
FIG. 23 is a cross-sectional view taken along line 23—23 of FIG. 22.
Figure 22:
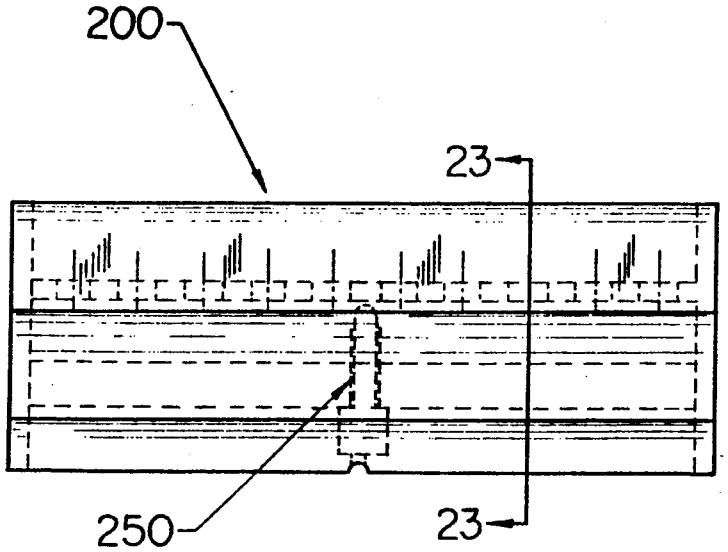
FIG. 22 is a front view showing a third embodiment, which has a plurality of note-holders, all of which are powered from one DC-AC transformer power source, which embodiment may be used in offices, and which has a plurality of note-holders arranged in series, one holder for one employee.
Figure 24:
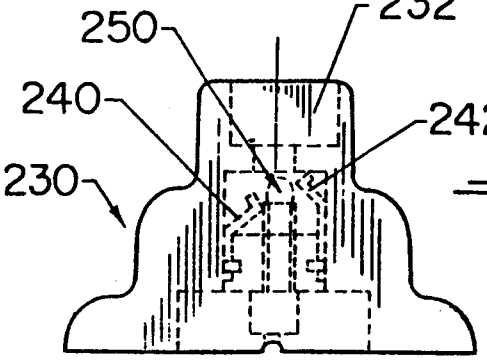
FIG. 24 is a detail view showing the coupling of the prong-electrode for supplying DC power to the note-holder device.
Figure 26:
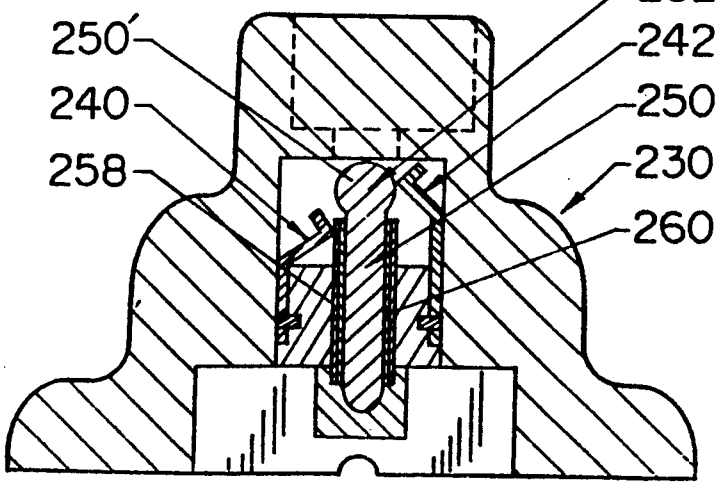
FIG. 26 a cross-sectional view taken along line 26—26 of FIG. 25.

The mounting frame 230 defines an interior, horizontal, rectangular-shaped opening 236 extending substantially the full length thereof in which are mounted a first elongated positive-electrode metal bracket 240 and a second negative-electrode metal bracket 242, each metal bracket 240, 242 extending substantially the full length of the frame 230. Each metal bracket 240, 242 is also suitably anchored in place via an anchor-block 231. The positive electrode bracket 240 contacts each positive electrode inner member or shaft 220 via its downwardly-projecting lower end portion 220', while the negative-electrode bracket 242 contacts the negative-electrode outer member 222 at its downwardly-projecting end portion 222', as seen in FIG. 23. Power is supplied to each note-holder unit 210 via a plug-adapter 250, as best seen in FIG. 26. The plug-adapter is conventional and includes an inner negative-electrode member 252 ending in an enlarged protuberance 252' that contact the longitudinally central portion of the metal bracket 242. The plug-adapter 250 also has an outer positive-electrode member 258 that contacts the metal bracket 240. The inner and outer electrodes 252 and 258 are isolated from each other by an electrically-insulating layer 260. The plug-adapter forms part of a conventional transformer for converting AC power to DC.

It may, therefore, be seen that each holder 210 is powered from one transformer unit, with each holder 210 being removable from its respective chamber 232 for independent use, as well as for replacement of parts.

While specific embodiments of the invention have shown and described, it is to be understood that numerous changes and modifications may be made therein without departing from the scope, spirit and intent of the invention as set forth in the appended claims.

What I claim is:

1. A holder for holding messages, notes, paper, and then like, comprising:

a first jaw member comprising a first clamping face;

a second jaw member comprising a second clamping face;

mounting means for rotatably mounting said second jaw member with respect to said first jaw member for moving said clamping surfaces toward and away from each other to clamp and release, respectively, a note therebetween;

biassing means for urging said first and second jaw members into a clamping state where said first and second clamping faces are urged toward each other;

illuminating means mounted by at least one of said first and second jaw members;

power source means for energizing said illuminating means;

switch means operatively positioned between said illuminating means and said power source means for alternatively opening and closing the couplement of said illuminating means with said power source means;

said switch means being at least partially mounted by said second jaw member, said switch means comprising means responsive to the pivotal movement of said second jaw member for alternatively coupling and decoupling said power source means from said illuminating means in response to the pivotal rotations of said second jaw member, said pivotal rotations of said second jaw member occurring in same direction.

2. The holder according to claim 1, wherein said first jaw member is stationary, and said second jaw member is rotatable with respect to said first stationary jaw member; said mounting means comprising a housing fixed to said first jaw member, and a tubular sleeve fixed to said second jaw member for rotation therewith and telescopingly received in said housing for rotation therein.

3. The holder according to claim 2, wherein said switch means is mounted in said tubular sleeve and comprises a first ratchet wheel mounted in said tubular sleeve for rotation therewith and having a side surface comprising engagement teeth, a second ratchet wheel operatively coupled to said first ratchet wheel and having a first and second side surface each comprising a series of engaging teeth, and a third ratchet face having engagement teeth, said second ratchet wheel being sandwiched between said first ratchet wheel and said third ratchet face;

said series of engaging teeth of each of said first and second side surfaces of said second ratchet wheel comprising an alternating pattern of shallow and deep engaging surfaces, whereby said engaging teeth of said first ratchet wheel is alternatively brought into engagement with a shallow and a deep engaging surfaces for alternatively disconnecting and connecting said power source means to said illuminating means.

4. The holder according to claim 1 wherein said series of engaging teeth of said first side surface is out of phase with said series of engaging teeth of said second side surface.

5. The holder according to claim 3, wherein said illuminating means comprises an illuminating housing, said illuminating housing having a rear portion, said third ratchet face being provided on said rear portion of said illuminating housing; said illuminating housing being stationarily mounted by said housing of said first jaw member.

6. The holder according to claim 5, wherein said illuminating means comprises a LED mounted by said illuminating housing, said LED having a pair of electrodes, said illuminating housing comprising cutouts for receiving said pair of electrodes therein; said illuminating housing having a forward portion from which projects said LED; said housing of said first jaw member having an opening through which projects said LED, so as to be visible to the outside.

7. The holder according to claim 6, wherein said illuminating housing comprises a first smaller-diameter portion mounted in said tubular sleeve, and a second larger diameter portion projecting from the open end of said tubular sleeve and mounted in said housing of said first jaw member in close juxtaposition to said opening thereof.

8. The holder according to claim 3, wherein said switch means further comprises a compression spring for urging said teeth on said ratchet faces together into operative contact, said spring comprising a main body portion having a first extended end, and a second end, each of said first and second ratchet wheels and said illuminating means having an opening through which passes said first end of said spring; said illuminating means having a positive and a negative electrode, said first end of said spring contacting one of said electrodes when said shallow teeth are engaged by said engaging teeth of said first ratchet wheel.

9. The holder according to claim 8, wherein said second end of said spring is connected to said power source, said switch means further comprising a spring clip having a first end connected to the other of said first and second electrodes of said illuminating means, and a second end connected to said power source; said power source comprising battery means having at least one positive terminal and at least one negative terminal, said second end of said spring contacting one of said first and second terminals, and said second end of said spring clip contacting the other of said of said first and second terminals.

10. The holder according to claim 1, wherein said power source means comprises at least one battery, a battery housing for said at least one battery, said battery housing being removably mounted to said first jaw member; said battery housing having means for mounting said jaw holder to a surface.

11. The holder according to claim 1, wherein said second jaw member is stationary; said second jaw member being made of a flexible material; said biassing means comprising a biassing arm having a first end portion connected to said second jaw member, and a second end portion spaced from said first end portion; said first jaw member having a means for retaining said second end portion of said biassing arm in tension, said biassing arm being made of said materials as said second jaw member and formed integrally therewith, whereby said jaw members are urged into their clamping state.

12. The holder according to claim 2, wherein said said second jaw member is made of a flexible material; said biassing means comprising a biassing arm having a first end portion connected to said second jaw member, and a second end portion spaced from said first end portion; said first jaw member having a means for retaining said second end portion of said biassing arm in tension, said biassing arm being made of said materials as said second jaw member and formed integrally therewith, whereby said jaw members are urged into their clamping state; second jaw member comprising an upper end portion, a lower end portion, and an intermediate portion; said lower end portion comprising said second clamping face, said intermediate portion mounting integrally therewith said tubular sleeve, and third upper end portion projecting therebeyond for movement toward said first jaw member;

said biassing arm also being connected to said intermediate portion and projecting therefrom toward said first jaw member, said biassing arm being arcuate, said second end portion thereof comprising a hook means for catching said means for retaining of said first jaw member to be held thereby.

13. The holder according to claim 12, wherein said biassing arm is spiral-shaped, said hook means comprising a camming surface for use in mounting to said means for retaining for urging said biassing arm away from said means for retaining assembly; said means for retaining comprising a protuberance projecting from a rear surface portion of said first jaw member.

14. The holder according to claim 1, comprising a mounting frame, and a plurality of holders arranged in a series mounted by said mounting frame; said power source powering each said holder, and comprising power-adapter means comprising a prong insert; said mounting frame comprising a mounting means for supporting said plurality of holders, a power electrode operatively connectable to the positive electrode of each said illuminating means of each said holder, a negative electrode connected to the negative electrode of each said illuminating means of each said holder, and means for receiving said prong insert for the electrical coupling thereof to said positive and negative electrodes of said main frame.

* * * * *